US007635266B1

(12) United States Patent
Brown et al.

(10) Patent No.: US 7,635,266 B1
(45) Date of Patent: Dec. 22, 2009

(54) ROTARY ELECTRICAL CONTACT DEVICE

(75) Inventors: Christopher Allen Brown, Bloomington, IN (US); John Felix Schneider, Huntingburg, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 12/334,070

(22) Filed: Dec. 12, 2008

(51) Int. Cl.
*H05G 1/60* (2006.01)

(52) U.S. Cl. ..... 439/25; 439/24; 378/15

(58) Field of Classification Search ..... 439/25, 439/24; 378/15
See application file for complete search history.

(56) References Cited

U.S. PATENT DOCUMENTS 2,820,207 A 1/1958 Roy et al.
2,854,647 A * 9/1958 Nugent ..... 439/25
3,517,369 A 6/1970 Buschbom
4,098,526 A 7/1978 DBois
4,209,214 A 6/1980 Martinez
4,798,540 A * 1/1989 Bernardi ..... 439/22
4,850,881 A 7/1989 Lagier et al.
5,470,236 A 11/1995 Wissler
6,068,490 A * 5/2000 Salzberg ..... 439/25
7,037,126 B2 5/2006 Tsutsumi et al.
7,497,689 B2 * 3/2009 Sommer ..... 439/24

* cited by examiner

*Primary Examiner*—Gary F. Paumen
(74) *Attorney, Agent, or Firm*—Christopher A. Monsey

(57) ABSTRACT

A rotary electrical contact device includes a stationary member configured to be coupled to a base, and a rotatable member supported for rotation relative to the stationary member and defining a center opening. A raceway includes a plurality of axially spaced annular contact rings supported by one of the stationary member and the rotatable member. A blade tower includes a plurality of axially spaced blade assemblies and is supported by the other of the rotatable member and the stationary member. Each blade assembly includes a radially extending contact blade in electrical communication with one of the axial spaced contact rings of the raceway.

17 Claims, 8 Drawing Sheets

ROTARY ELECTRICAL CONTACT DEVICE

STATEMENT REGARDING FEDERALLY SPONSORED RESEARCH OR DEVELOPMENT

The invention described herein was made in the performance of official duties by employees of the Department of the Navy and may be manufactured, used, licensed by or for the United States Government for any governmental purpose without payment of any royalties thereon.

BACKGROUND OF THE INVENTION

The present invention relates generally to electrical contact devices and, more particularly, to rotary electrical contact devices for providing electrical communication between components that rotate relative to each other.

Conventional couplings are known to rotatably couple a stationary member and a rotating member, wherein the rotating member is configured to receive the torso of an individual. The stationary member may be coupled to a vehicle and the rotating member may support a variety of components or accessories, such as a turret, a crane, an antenna, a camera, or a ladder. Electrical communication is often required between the stationary member and the rotating member, for example, to provide communication signals to the operator through a port on the rotating member, or to provide power to the respective accessory supported by the rotating member. Traditional cables between the stationary member and the rotating member for providing electrical communication therebetween are typically cumbersome and may become entangled during rotation. While traditional slip rings may provide electrical communication between the stationary member and the rotating member, they are not designed to provide adequate clearance through the center thereof for the torso of an individual and/or associated equipment.

SUMMARY OF THE INVENTION

According to an illustrative embodiment of the present disclosure, a rotary electrical contact device includes a stationary member configured to be coupled to a base, and a rotatable member supported for rotation relative to the stationary member. The rotatable member defines a center opening configured to permit the traversing of an individual therethrough. A raceway includes a plurality of axially spaced annular contact rings supported by one of the stationary member and the rotatable member. A blade tower includes a plurality of axially spaced blade assemblies and is supported by the other of the rotatable member and the stationary member. Each blade assembly includes a radially extending contact blade in electrical communication with one of the axial spaced annular contact rings of the raceway.

According to a further illustrative embodiment of the present disclosure, a rotary electrical contact device includes an outer stationary member, and an inner rotatable member supported for rotation relative to the stationary member, the inner rotatable member defining a center opening. A raceway includes a plurality of axially spaced annular contact rings supported by one of the outer stationary member and the inner rotatable member. A blade tower includes a plurality of axially spaced blade assemblies and is supported by the other of the inner rotatable member and the outer stationary member. Each blade assembly includes a contact blade and a spring to radially bias the contact blade into electrical communication with one of the axially spaced annular contact rings of the raceway.

According to another illustrative embodiment of the present disclosure, a rotary electrical contact device for use with a vehicle includes an outer stationary member configured to be coupled to a vehicle platform, and a raceway. The raceway includes opposing ends, a plurality of axial spaced contact rings, a plurality of annular insulators receiving the plurality of contact rings, and a plurality of circumferentially spaced mounting brackets coupling the annular insulators to the outer stationary member. An inner rotatable member is supported for at least 360 degree rotation relative to the stationary member. The inner rotatable member defines a center opening having a diameter of at least 26 inches to permit the traversing of an individual therethrough. A blade tower includes a plurality of axially spaced blade assemblies and is supported by the inner rotatable member, each blade assembly including a contact blade and a spring to radially outwardly bias the contact blade into electrical communication with one of the axially spaced contact rings of the raceway. A connector joins together opposing ends of the raceway to form a cylindrical structure.

According to yet another illustrative embodiment of the present disclosure, a method of providing electrical communication includes the steps of providing a stationary member, and providing a rotatable member for rotation relative to the stationary member, the rotatable member defining a center opening. The method further includes the steps of coupling a raceway to one of the stationary member and the rotatable member, the raceway including a plurality of axially spaced annular contact rings. The method also includes the steps of coupling a blade tower to the other of the rotatable member and the stationary member, the blade tower including a plurality of axially spaced blade assemblies, each blade assembly including a radially extending contact blade in electrical communication with one of the axially spaced contact rings of the raceway. The method also includes the steps of traversing an individual within the center opening of the rotatable member, and rotating the rotatable member relative to the stationary member, wherein the contact blades of the blade assemblies remain in electrical communication with the contact rings of the raceway.

BRIEF DESCRIPTION OF THE DRAWINGS

The foregoing aspects and many of the attendant advantages of this invention will become more readily appreciated as the same become better understood by reference to the following detailed description when taken in conjunction with the accompanying drawings.

Figure 1:
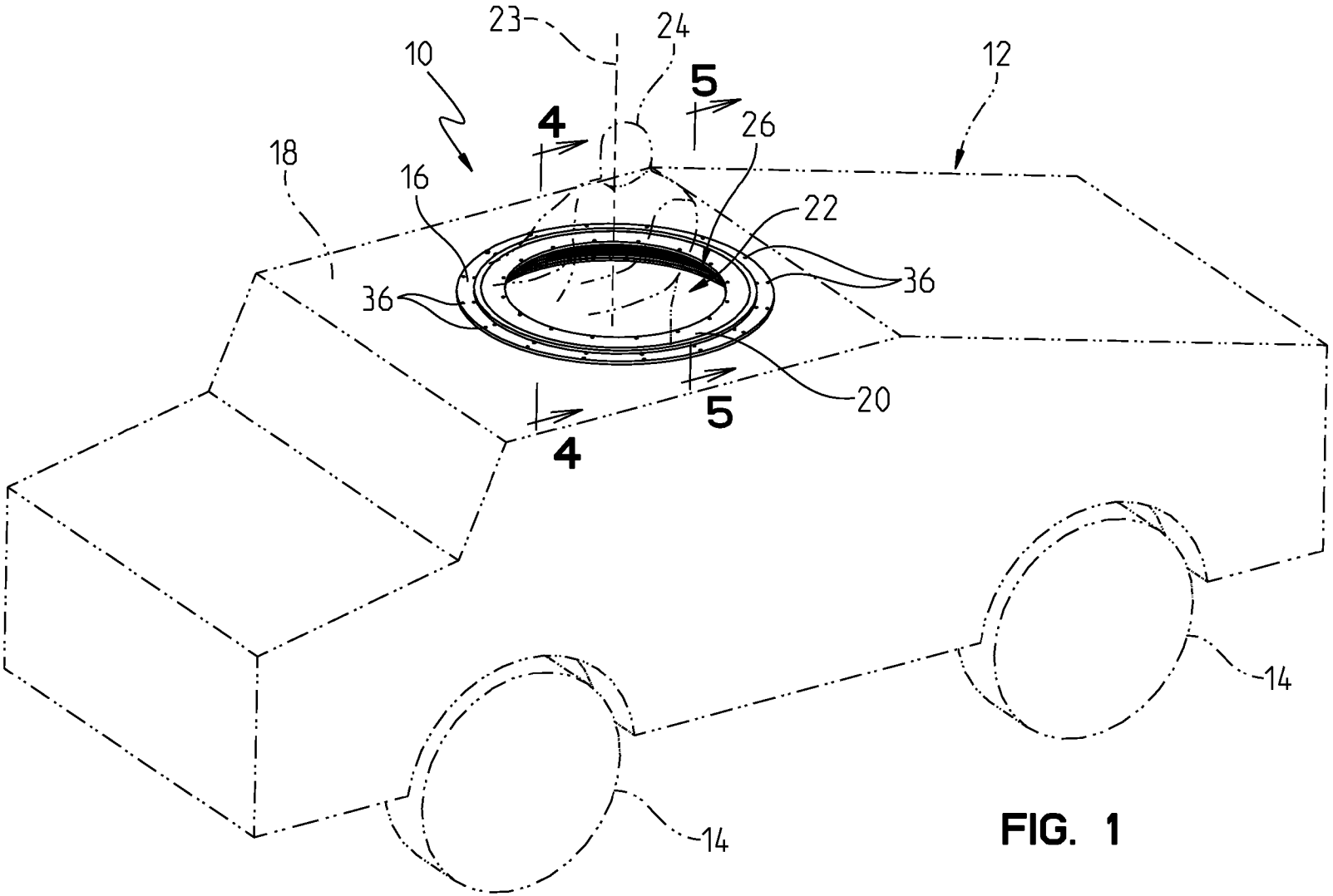
FIG. 1 is a perspective view of an illustrative rotary electrical contact device coupled to a vehicle.

Corresponding reference characters indicate corresponding parts throughout the several views. Although the drawings represent embodiments of various features and components according to the present disclosure, the drawings are not necessarily to scale and certain features may be exaggerated in order to better illustrate and explain the present disclosure. The exemplification set out herein illustrates embodiments of the invention, and such exemplifications are not to be construed as limiting the scope of the invention in any manner.

DETAILED DESCRIPTION OF THE DRAWINGS

For the purposes of promoting an understanding of the principles of the invention, reference will now be made to the embodiments illustrated in the drawings, which are described below. The embodiments disclosed below are not intended to be exhaustive or limit the invention to the precise form disclosed in the following detailed description. Rather, the embodiments are chosen and described so that others skilled in the art may utilize their teachings. It will be understood that no limitation of the scope of the invention is thereby intended. The invention includes any alterations and further modifications in the illustrated devices and described methods and further applications of the principles of the invention which would normally occur to one skilled in the art to which the invention relates.

Referring initially to FIG. 1, an illustrative embodiment rotary electrical contact device 10 is shown coupled to a vehicle 12. While the following description describes the rotary electrical contact device 10 for use in connection with a vehicle 12 including a plurality of wheels 14, it should be appreciated that the device 10 may find use in other applications, including being mounted to a stationary support (not shown). Further, the illustrative vehicle 12 in the embodiment of FIG. 1 may be of any conventional type, such as military vehicles, law enforcement vehicles, rescue trucks, communications vehicles, and construction equipment.

Figure 2:
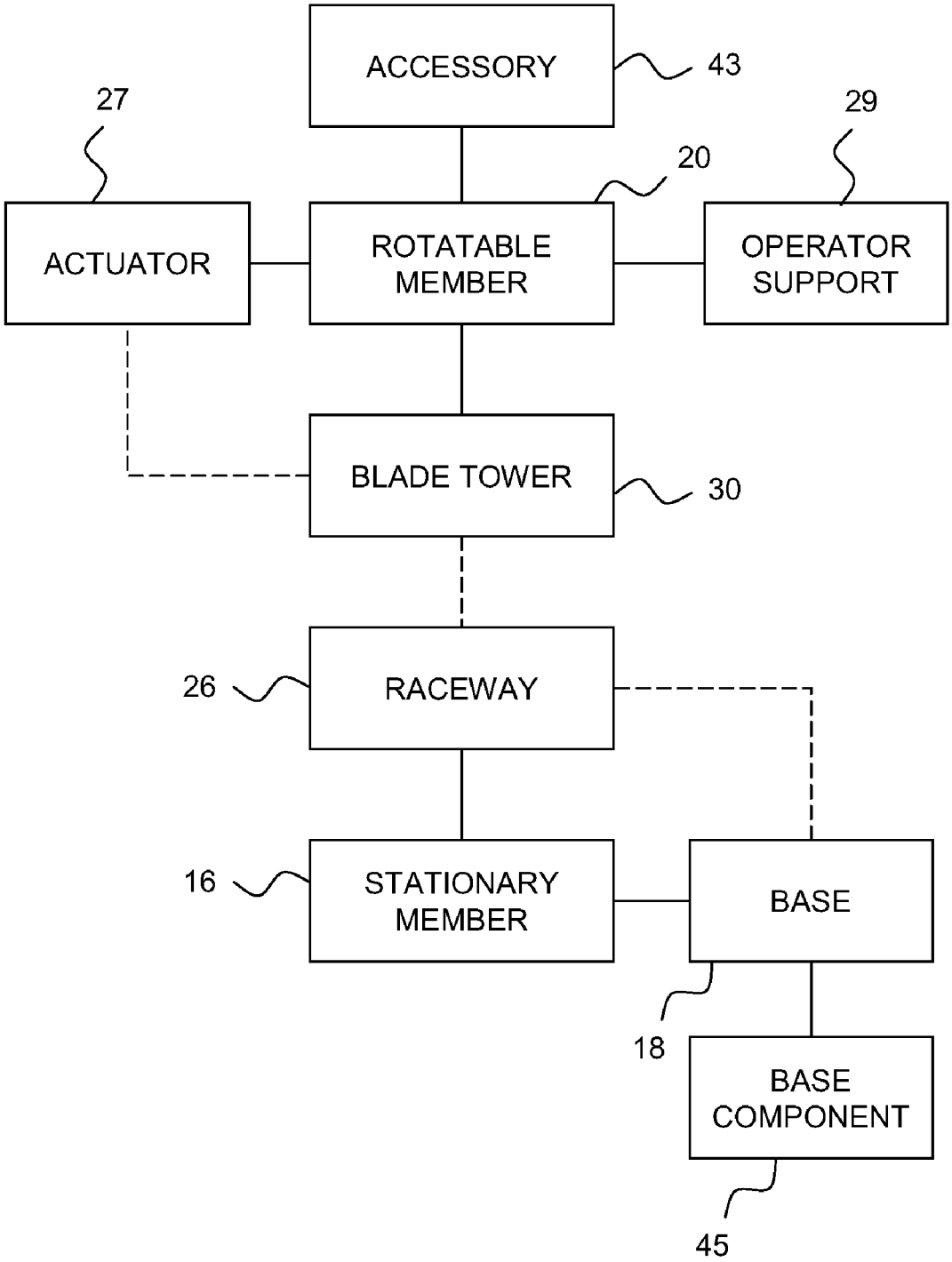
FIG. 2 is a diagrammatic representation of the illustrative rotary electrical contact device of FIG. 1 operably coupling an accessory to a base.
Figure 3:
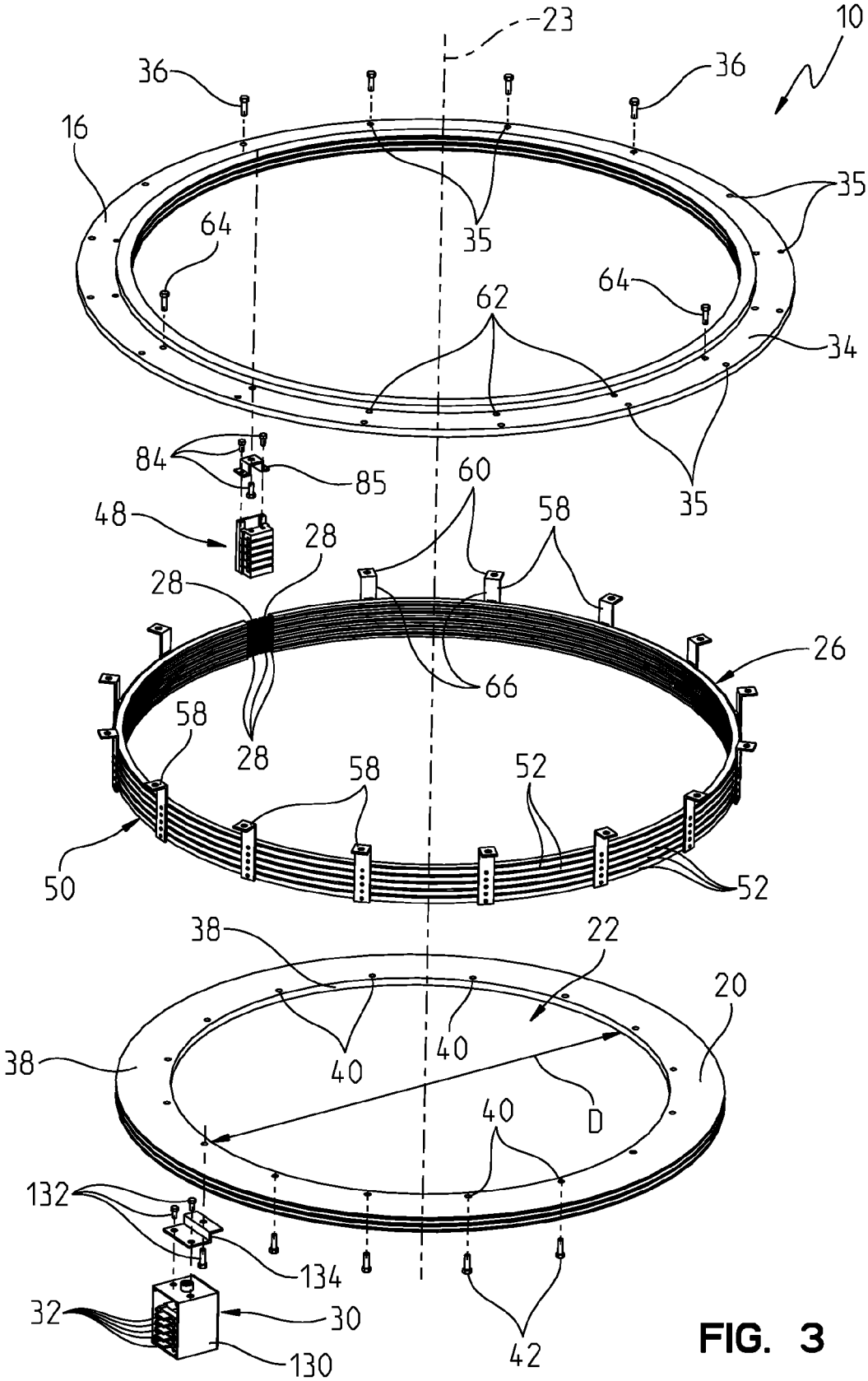
FIG. 3 is an exploded perspective view of the illustrative rotary electrical contact device of FIG. 1.

With reference to FIGS. 1-3, the rotary electrical contact device 10 illustratively includes an annular outer stationary member 16 configured to be coupled to a base 18, illustratively a vehicle platform. An annular inner rotatable member 20 is illustratively supported for rotation relative to the stationary member 16 and is concentrically received within the outer stationary member 16. The inner rotatable member 20 defines a center opening 22 having a longitudinal axis 23 and configured to receive the torso of an individual 24, typically an operator associated with the vehicle 12. More particularly, the center opening 22 of the rotatable member 20 is configured to permit the traversing thereof by the torso of individual 24 (i.e., ingress and egress within the center opening 22). Illustratively, the center opening 22 has an inner diameter D of at least 26 inches based upon the shoulder width of an average adult male. In one illustrative embodiment, the inner diameter D of center opening 22 is approximately 42 inches in order to accommodate the clothing of individual 24 and to permit the manipulation of equipment within opening 22 by individual 24.

Figure 4:
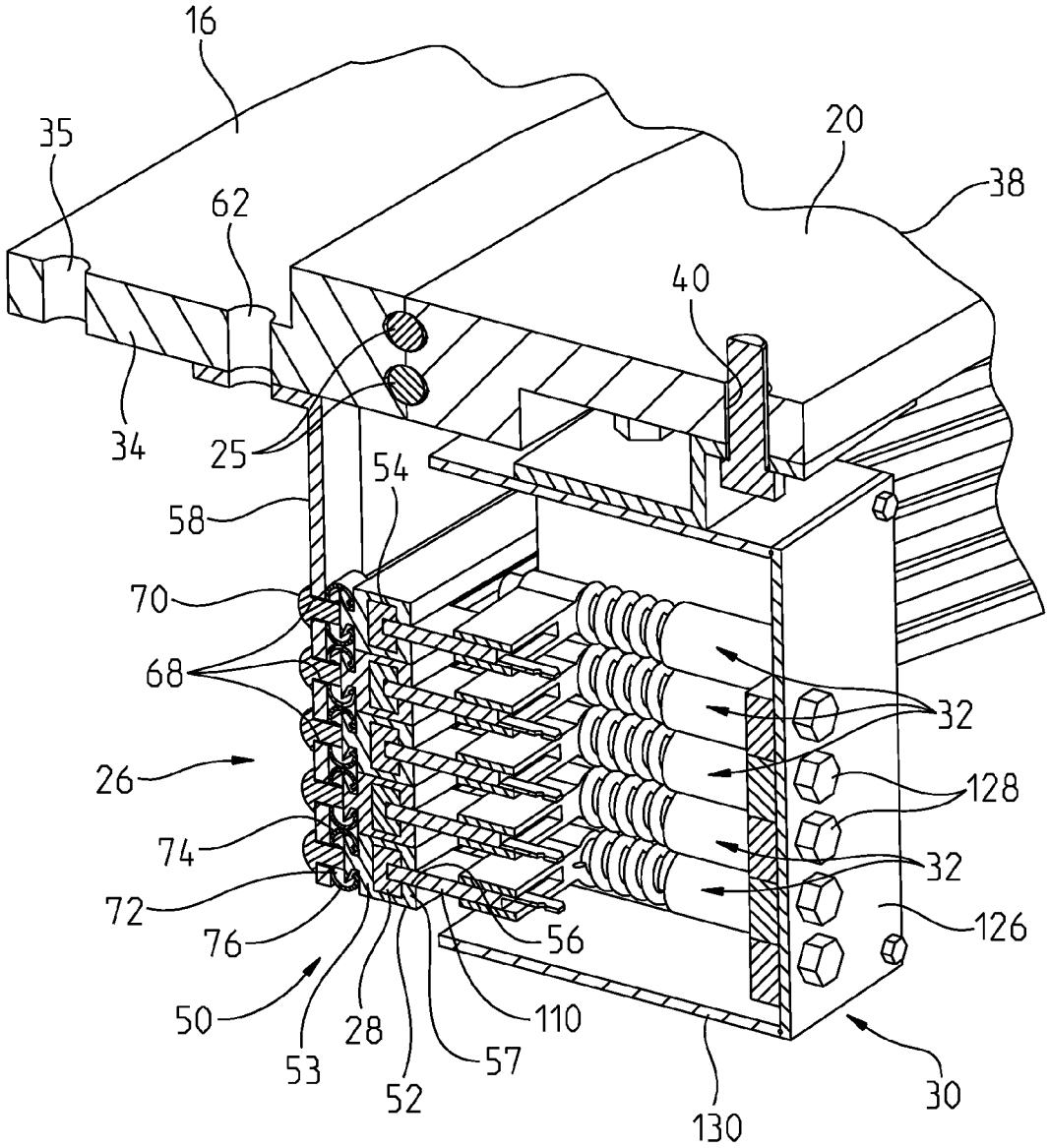
FIG. 4 is a cross-sectional view of the illustrative rotary electrical contact device taken along line 4-4 of FIG. 1.
Figure 5:
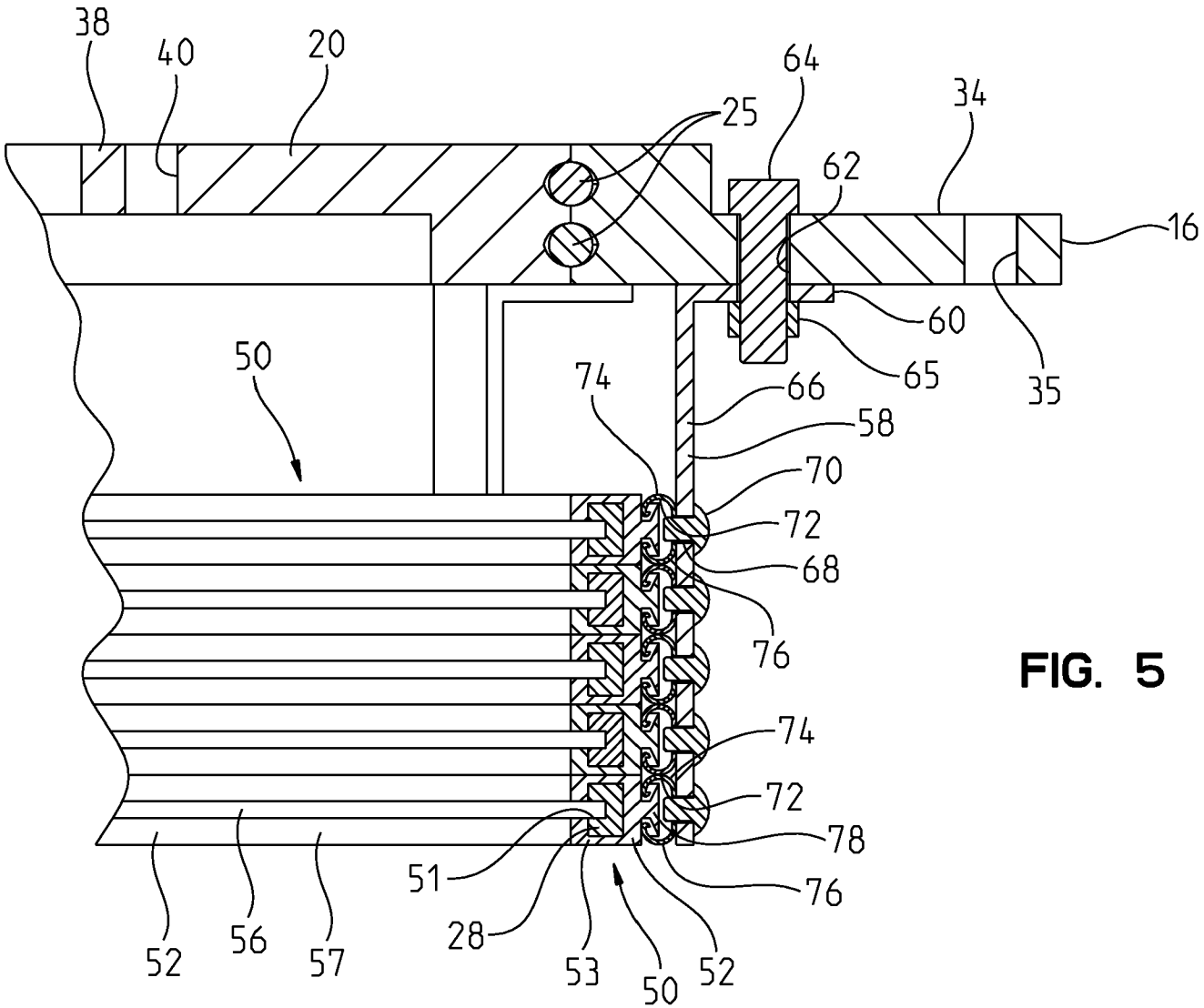
FIG. 5 is a cross-sectional view of the illustrative rotary electrical contact device taken along line 5-5 of FIG. 1.

Conventional bearings, such as ball bearings 25, are illustratively supported intermediate the stationary member 16 and the rotatable member 20 (FIGS. 4 and 5). With reference to FIG. 2, an actuator 27, such as an electric motor and gear train, may be coupled in a conventional manner to the rotatable member 20 to drive the rotatable member 20 in rotation relative to the stationary member 16. Alternatively, the rotatable member 20 may be manually rotated by the individual 24 received within the center opening 22. In certain illustrative embodiments, an operator support 29 (FIG. 2), such as a stand or seat, may be supported by the rotatable member 20, such that the individual 24 rotates concurrently with the rotatable member 20.

Referring again to FIGS. 2 and 3, a raceway 26 is illustratively supported by the stationary member 16 and includes a plurality of axially spaced annular contact rings 28. A blade tower 30 is illustratively supported by the rotatable member 20 and includes a plurality of axially spaced blade assemblies 32. As further detailed herein, the blade assemblies 32 of the blade tower 30 cooperate with the contact rings 28 of the raceway 26 to provide continuous electrical communication therebetween regardless of the rotational position of the rotatable member 20 relative to the stationary member 16.

With reference to FIGS. 3-5, the stationary member 16 includes an annular outer mounting flange 34 having a plurality of mounting holes 35 for receiving fasteners 36 for coupling to the vehicle platform or base 18 (FIG. 1). Similarly, the rotatable member 20 includes an annular inner mounting flange 38 having a plurality of mounting holes 40 for receiving fasteners 42 for securing thereto an accessory 43 (FIG. 2), such as a turret in connection with a military vehicle, an antennae or a camera in connection with a communications vehicle, a crane in connection with construction equipment, or a ladder in connection with a rescue or maintenance truck (not shown). An electrical base component 45, such as a power supply, controller, communication unit, etc., may be supported by the base 18 and is in electrical communication with the accessory 43 through the rotary electrical contact device 10.

Figure 6:
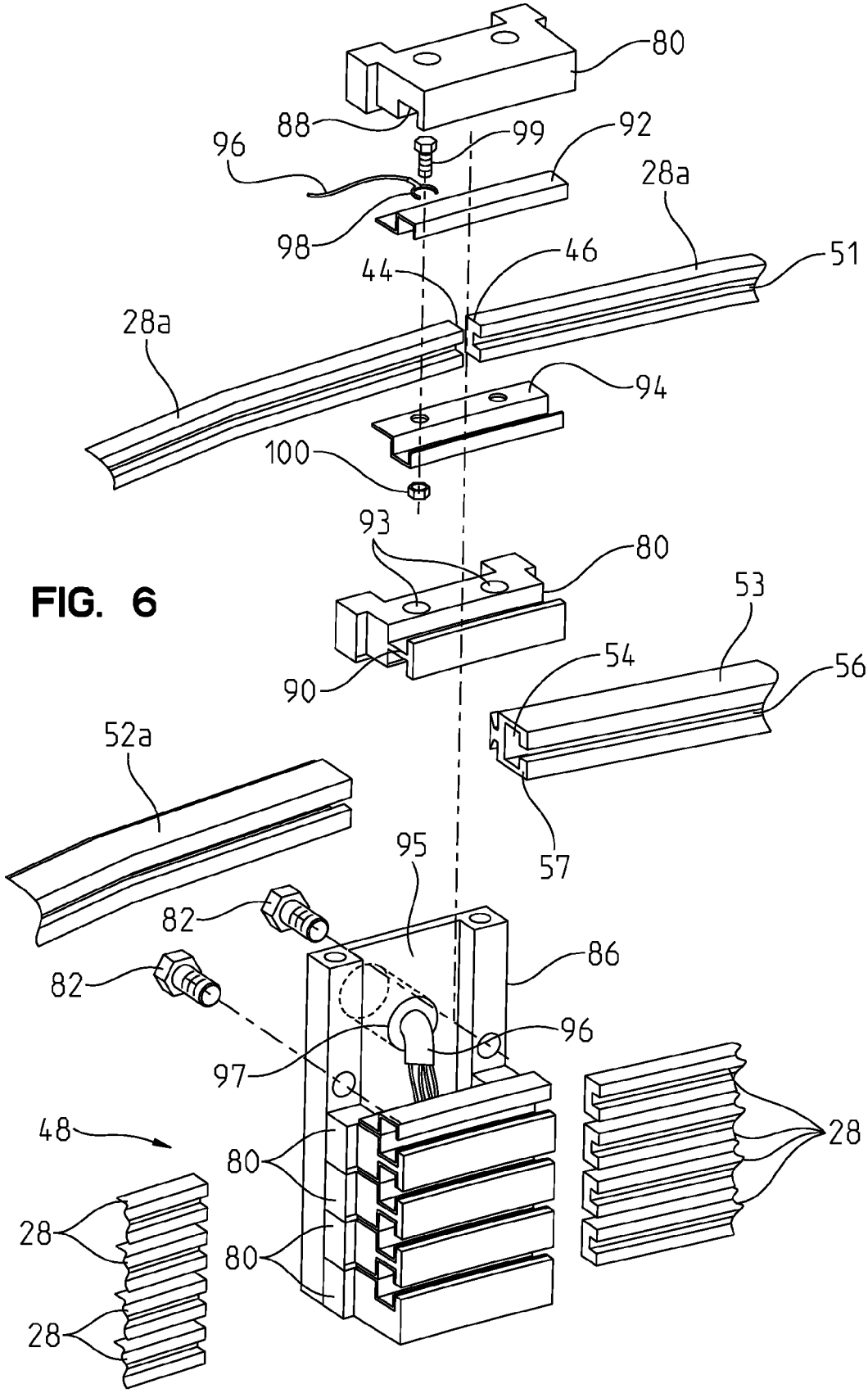
FIG. 6 is a partially exploded perspective view of the illustrative connector of FIG. 1.

Referring to FIGS. 3 and 6, the contact rings 28 of the raceway 26 include opposing ends 44 and 46 which are coupled together through a connector 48. The plurality of annular contact rings 28 are supported by an insulator assembly 50. Each annular contact ring 28 is illustratively formed of an electrically conductive material, such as copper, formed into an annular configuration. Each contact ring 28 illustratively includes a radially outwardly disposed guide slot 51 for cooperating with an associated blade assembly 32.

With reference FIGS. 4-6, the insulator assembly 50 includes a plurality of axially aligned annular insulators 52, each formed of an electrically insulating material, such as a thermoplastic or elastomer. Each annular insulator 52 includes a body 53 defining a chamber 54 for receiving one of the contact rings 28. A slot 56 is formed in a radially inner wall 57 of the insulator body 53 and is in communication with each chamber 54. Each slot 56 is configured to cooperate with an associated blade assembly 32 and is aligned with guide slot 51 of a respective contact ring 28. While the illustrative embodiment shows five contact rings 28 and insulators 52, any number of contact rings 28 and insulators 52 may be utilized in connection with the rotary electrical contact device 10 depending upon the desired application. For instance, in one illustrative embodiment a total of eight contact rings 28 and associated insulators 52 are utilized, with three of the contact rings 28 being dedicated for electrical power transfer and five of the contact rings 28 being dedicated for communication functions (including the transmission of audio and video signals).

With reference to FIGS. 3-5, a plurality of circumferentially spaced mounting brackets 58 are supported by the stationary member 16 and extend downwardly from the outer mounting flange 34. The mounting brackets 58 are substantially L-shaped and include radially extending bases 60 mounted to openings 62 in the outer mounting flange 34 by fasteners, such as bolts 64 and cooperating nuts 65 (FIG. 5). An axially extending leg 66 is coupled to each base 60 and includes a plurality of openings 68 for receiving fasteners 70 to secure a plurality of mounting clips 72 thereto. The clips 72 are substantially U-shaped and include opposing arms 74 and 76 which couple to the insulators 52. More particularly, each insulator 52 includes a T-shaped mounting tab 78 which is snap fit into the arms 74 and 76 of the clip 72. Each clip 72 is illustratively formed of a resilient material such that the arms 74 and 76 are biased into engagement with the mounting tab 78 of the insulator 52. In one illustrative embodiment, the clips 72 are formed of spring steel.

With reference to the illustrative embodiment of FIG. 6, the connector 48 may include a plurality of axially aligned clamp or securing members 80 which are coupled through fasteners 82 to a support bracket 86. The support bracket 86 is secured to the outer mounting flange 34 of the stationary member 16 through conventional fasteners 84 and mounting bracket 85 (FIG. 3). The opposing ends 44 and 46 of the contact rings 28 are coupled together by the clamp members 80 of the connector 48. More particularly, the clamp members 80 cooperate to define opposing securing surfaces 88 and 90 to secure the opposing ends 44 and 46 of the contact rings 28 therebetween. Connector contacts 92 and 94 are illustratively positioned between the opposing securing surfaces 88 and 90 and are in electrical communication with the ends 44 and 46 of the respective contact ring 28.

Electrical wires 96 may be coupled to the contacts 92 and 94 and pass through a channel 95 formed in the support bracket 86. The wires 96 may be coupled to a conventional multi-pin connector 97, thereby providing communication between the contact rings 28 and the component 45 supported by the base 18. The wires 96 may be coupled to the contacts 92 and 94 in a variety of manners, for example through soldering or through a contact clip or tab 98. The contact clip 98 may be a C-clip coupled to wire 96 and secured to the contact 92 through a fastener, such as a bolt 99 and nut 100. Openings 93 within the clamp members 80 may receive the head of bolts 99 and the nuts 100.

Figure 7:
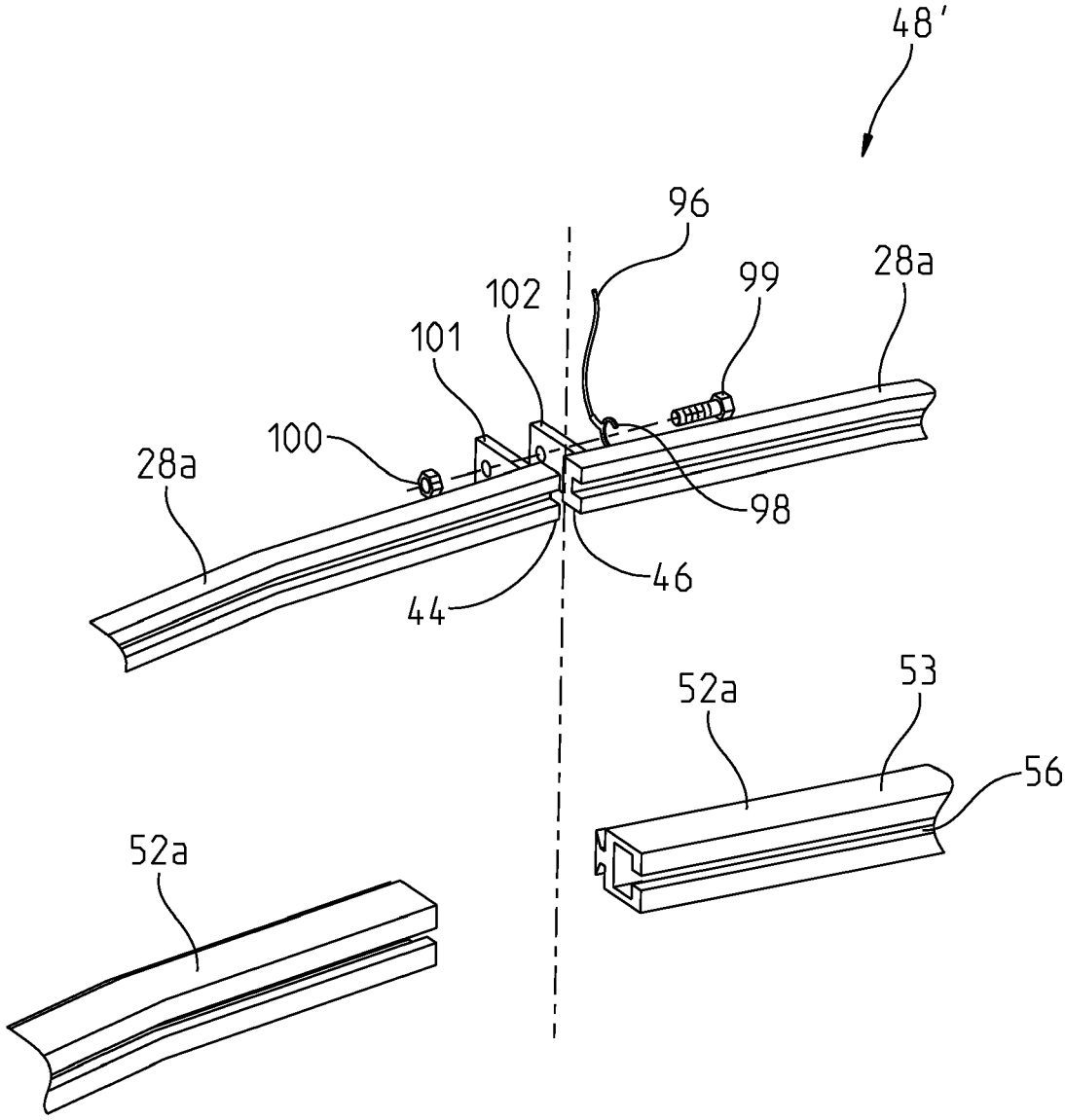
FIG. 7 is an exploded perspective view of a further illustrative connector.

In an alternative embodiment of FIG. 7, the connector 48' includes opposing tabs 101 and 102 coupled to ends 44 and 46 of each annular contact ring 28. A fastener, illustratively bolt 99 and nut 100, couple together the opposing ends 44 and 46, while contact clip 98 provides electrical communication with wire 96.

Figure 8:
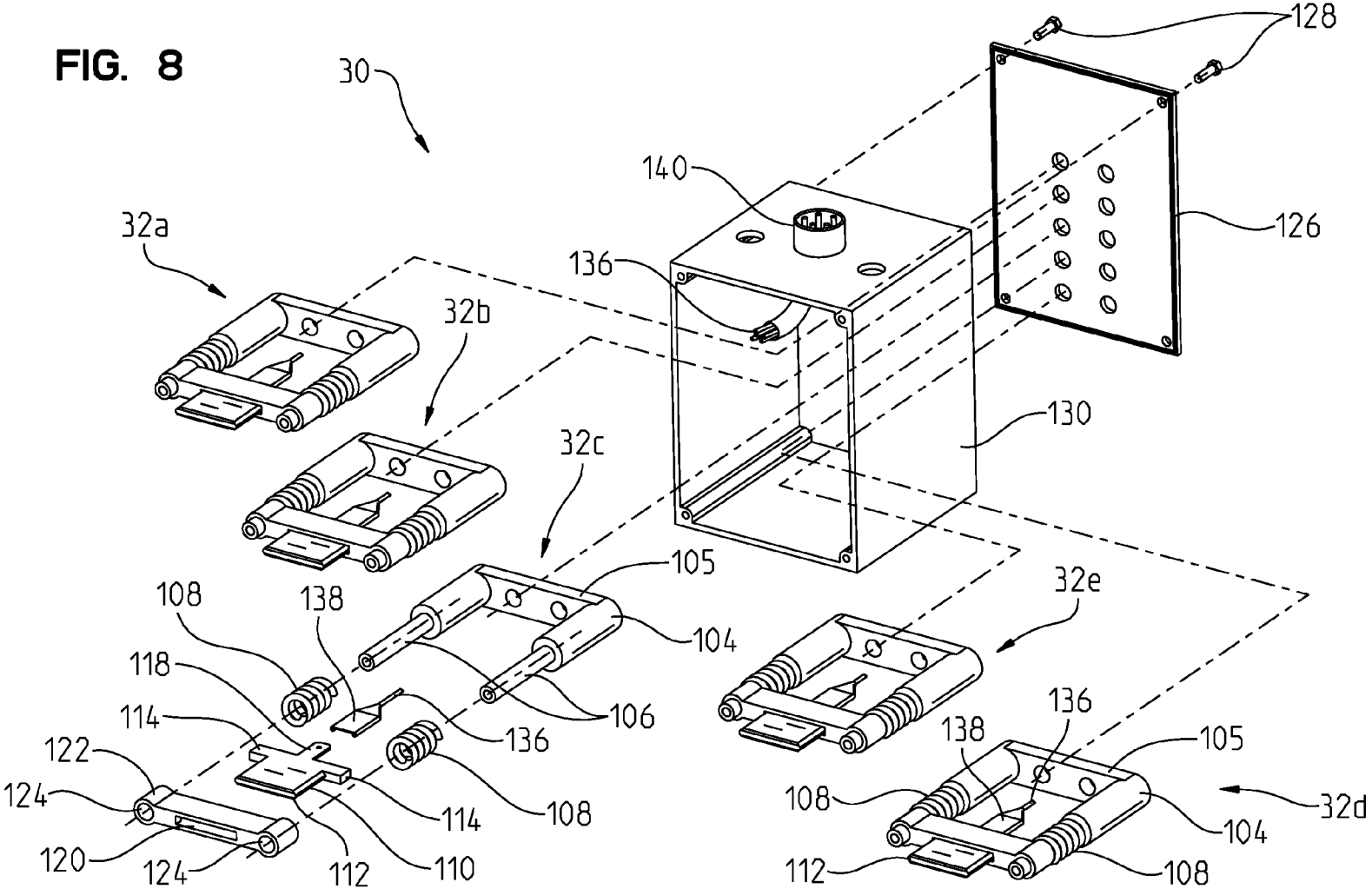
FIG. 8 is a partially exploded perspective view of the illustrative blade tower of FIG. 1.

With reference to FIG. 8, the illustrative blade tower 30 includes the plurality of axially spaced blade assemblies 32. Each blade assembly 32 includes a base 104 having a mounting portion 105 and a pair of guide members or posts 106. The posts 106 slidably receive a pair of springs 108 configured to engage and bias radially outwardly a contact blade 110. The contact blade 110 is formed of a flexible electrically conductive material, such as copper. The blade 110 includes an outer contact member 112, a pair of arms 114, and a coupling tab 118. The outer end of the contact member 112 is configured to contact and provide electrical communication with one of the contact rings 28. The arms 114 cooperate with the springs 108 to bias the contact member 112 radially outwardly. The radial biasing of the contact members 112 accommodate dimensional tolerances given the relatively large diameter of the raceway 26 by ensuring electrical contact between the blade assemblies 32 and the annular contact rings 28.

The contact member 112 is received within a slot 120 formed within a holder 122 to secure the contact blade 110 within the blade assembly 32. The outer end of each contact member 112 passes through the slot 56 of the insulator 52 and is received within the guide slot 51 of the contact ring 28 to provide electrical contact therebetween. Receiving bores 124 in the holder 122 receive the posts 106 and the holder 122 is secured in position by conventional means, such as a fastener, staking, or adhesive.

The base 104 of each blade assembly 32 is coupled to a backing plate 126 through conventional fasteners 128. The backing plate 126, in turn, is secured to a housing 130 through conventional fasteners (not shown) and which receives the plurality of blade assemblies 32. The housing 130 is coupled to the rotatable member 20 through fasteners 132 and mounting bracket 134 (FIG. 3). Electrical wires 136 are illustratively coupled to a conventional push-to-connect type coupler 138 which slidably receives the tabs 118. The wires 136, through the tabs 118 of the contact blades 110, provide electrical communication to a conventional multi-pin connector 140, which is coupled to the accessory 43.

The stationary member 16 supporting the raceway 26 is coupled to the base 18 of the vehicle 12. As noted above, the rotatable member 20 is rotatably supported by the stationary member 16 and defines center opening 22. The blade tower 30 is coupled to move with the rotatable member 20 wherein the plurality of axially spaced blade assemblies 32 are in electrical communication with the axially spaced contact rings 28 of the raceway 26. Individual 24, typically a vehicle operator, inserts his torso within the center opening 22 of the rotatable member 20. In certain illustrative embodiments, the operator support 29 rotates concurrently with the rotatable member 20. As the rotatable member 20 rotates about the longitudinal axis 23, the contact blades 110 of the blade assemblies 32 remain in electrical communication with the contact rings 28 of the raceway 26.

In operation, the positioning of the operator within the opening 22 of the rotatable member 20 permits access to and operation of the accessory 43 coupled to the rotatable member 20. As detailed above, any number of contact rings 28 and associated blade assemblies 32 may be utilized depending upon the particular needs of the accessory 43. For example, multiple contact rings 28 and blade assemblies 32 may be utilized to provide for the transfer of electrical power and/or communication signals.

The rotary electrical contact device 10 eliminates the need for the accessory 43 supported by the rotatable member 20 to be self-powered, for example through batteries. Additionally, full rotation (i.e., at least a full 360 degrees) of the rotatable member 20 relative to the stationary member 16 may be accomplished without causing any entanglement of associated electrical cables.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

The invention claimed is:

1. A rotary electrical contact device comprising:

a stationary member configured to be coupled to a base;

a rotatable member supported for rotation relative to the stationary member, the rotatable member defining a center opening configured to permit the traversing of an individual therethrough;

a raceway including a plurality of axially spaced annular contact rings supported by one of the stationary member and the rotatable member; and a blade tower including a plurality of axially spaced blade assemblies and supported by the other of the rotatable member and the stationary member, each blade assembly including a radially extending contact blade in electrical communication with one of the axially spaced annular contact rings of the raceway, wherein the raceway includes a plurality of axially spaced annular insulators, each of the annular insulators including a cavity receiving one of the annular contact rings, and wherein the raceway further includes a plurality of circumferentially spaced mounting brackets coupled to the stationary member, and a plurality of clips coupling the annular insulators to the mounting brackets.

2. The rotary electrical contact device of claim 1, wherein each blade assembly further includes a contact blade and a spring to radially bias the contact blade into electrical communication with one of the axially spaced contact rings of the raceway.

3. A rotary electrical contact device comprising:

a stationary member configured to be coupled to a base;

a rotatable member supported for rotation relative to the stationary member, the rotatable member defining a center opening configured to permit the traversing of an individual therethrough;

a raceway including a plurality of axially spaced annular contact rings supported by one of the stationary member and the rotatable member; and a blade tower including a plurality of axially spaced blade assemblies and supported by the other of the rotatable member and the stationary member, each blade assembly including a radially extending contact blade in electrical communication with one of the axially spaced annular contact rings of the raceway, wherein each blade assembly further includes a contact blade and a spring to radially bias the contact blade into electrical communication with one of the axially spaced contact rings of the raceway, and wherein each blade assembly further includes a base including a post supporting the spring, and a holder supported by the base and including a slot receiving the contact blade.

4. A rotary electrical contact device comprising:

a stationary member configured to be coupled to a base;

a rotatable member supported for rotation relative to the stationary member, the rotatable member defining a center opening configured to permit the traversing of an individual therethrough;

a raceway including a plurality of axially spaced annular contact rings supported by one of the stationary member and the rotatable member; and a blade tower including a plurality of axially spaced blade assemblies and supported by the other of the rotatable member and the stationary member, each blade assembly including a radially extending contact blade in electrical communication with one of the axially spaced annular contact rings of the raceway; and a connector joining together opposing ends of the raceway to form a cylindrical structure.

5. A rotary electrical contact device comprising:

a stationary member configured to be coupled to a base;

a rotatable member supported for rotation relative to the stationary member, the rotatable member defining a center opening configured to permit the traversing of an individual therethrough;

a raceway including a plurality of axially spaced annular contact rings supported by one of the stationary member and the rotatable member; and a blade tower including a plurality of axially spaced blade assemblies and supported by the other of the rotatable member and the stationary member, each blade assembly including a radially extending contact blade in electrical communication with one of the axially spaced annular contact rings of the raceway; and a connector joining together opposing ends of the raceway to form a cylindrical structure, wherein the raceway includes a plurality of axially spaced annular insulators, each of the annular insulators including a cavity receiving one of the annular contact rings, and the connector includes a plurality of axially spaced clamping members configured to secure together the plurality of annular contact rings.

6. A rotary electrical contact device comprising:

an outer stationary member;

an inner rotatable member supported for rotation relative to the stationary member, the inner rotatable member defining a center opening; and a raceway including a plurality of axially spaced contact rings supported by one of the outer stationary member and the inner rotatable member;

a blade tower including a plurality of axially spaced blade assemblies and supported by the other of the inner rotatable member and the outer stationary member, each blade assembly including a contact blade and a spring to radially bias the contact blade into electrical communication with one of the axially spaced contact rings of the raceway, wherein the raceway includes a plurality of axially spaced annular insulators, each of the annular insulators including a cavity receiving one of the annular contact rings; and a plurality of circumferentially spaced mounting brackets coupled to the stationary member, and a plurality of clips coupling the annular insulators to the mounting brackets.

7. The rotary electrical contact device of claim 6, wherein the rotatable member is configured to support one of a turret, a crane, and a ladder.

8. A rotary electrical contact device comprising:

an outer stationary member;

an inner rotatable member supported for rotation relative to the stationary member, the inner rotatable member defining a center opening;

a raceway including a plurality of axially spaced contact rings supported by one of the outer stationary member and the inner rotatable member; and a blade tower including a plurality of axially spaced blade assemblies and supported by the other of the inner rotatable member and the outer stationary member, each blade assembly including a contact blade and a spring to radially bias the contact blade into electrical communication with one of the axially spaced contact rings of the raceway, wherein each blade assembly further includes a base including a post supporting the spring, and a holder supported by the base and including a slot receiving the contact blade.

9. A rotary electrical contact device comprising:

an outer stationary member;

an inner rotatable member supported for rotation relative to the stationary member, the inner rotatable member defining a center opening;

a raceway including a plurality of axially spaced contact rings supported by one of the outer stationary member and the inner rotatable member;

a blade tower including a plurality of axially spaced blade assemblies and supported by the other of the inner rotatable member and the outer stationary member, each blade assembly including a contact blade and a spring to radially bias the contact blade into electrical communication with one of the axially spaced contact rings of the raceway; and a connector joining together opposing ends of the raceway to form a cylindrical structure.

10. A rotary electrical contact device comprising:

an outer stationary member;

an inner rotatable member supported for rotation relative to the stationary member, the inner rotatable member defining a center opening;

a raceway including a plurality of axially spaced contact rings supported by one of the outer stationary member and the inner rotatable member; and a blade tower including a plurality of axially spaced blade assemblies and supported by the other of the inner rotatable member and the outer stationary member, each blade assembly including a contact blade and a spring to radially bias the contact blade into electrical communication with one of the axially spaced contact rings of the raceway further comprising a connector joining together opposing ends of the raceway to form a cylindrical structure;

wherein the raceway includes a plurality of axially spaced annular insulators, each of the annular insulators including a cavity receiving one of the annular contact rings, and the connector includes a plurality of axially spaced clamping members configured to secure together the plurality of annular contact rings.

11. A rotary electrical contact device for use with a vehicle, the rotary electrical contact device comprising:

an outer stationary member configured to be coupled to a vehicle platform;

a raceway including opposing ends, a plurality of axially spaced contact rings, a plurality of annular insulators receiving the plurality of contact rings, and a plurality of circumferentially spaced mounting brackets coupling the annular insulators to the outer stationary member;

an inner rotatable member supported for at least 360 degree rotation relative to the stationary member, the inner rotatable member defining a center opening having a diameter of at least 26 inches to permit the traversing of an individual therethrough;

a blade tower including a plurality of axially spaced blade assemblies and supported by the inner rotatable member, each blade assembly including a contact blade and a spring to radially outwardly bias the contact blade into electrical communication with one of the axially spaced contact rings of the raceway; and a connector joining together opposing ends of the raceway to form a cylindrical structure.

12. The rotary electrical contact device of claim 11, wherein the raceway further includes a plurality of clips, each of the plurality of clips including a pair of opposing arms, and each of the annular insulators include at least one tab lockingly received within the opposing arms.

13. The rotary electrical contact device of claim 11, wherein each blade assembly further includes a base including a post supporting the spring, and a holder supported by the base and including a slot receiving the contact blade.

14. A method of providing electrical communication, the method comprising the steps of:

providing a stationary member;

providing a rotatable member for rotation relative to the stationary member, the rotatable member defining a center opening;

coupling a raceway to one of the stationary member and the rotatable member, the raceway including a plurality of axially spaced annular contact rings;

coupling a blade tower to the other of the rotatable member and the stationary member, the blade tower including a plurality of axially spaced blade assemblies, each blade assembly including a radially extending contact blade in electrical communication with one of the axially spaced contact rings of the raceway;

traversing an individual within the center opening of the rotatable member; and rotating the rotatable member relative to the stationary member, wherein the contact blades of the blade assemblies remain in electrical communication with the contact rings of the raceway;

wherein the raceway includes opposing ends, and further comprising the step of coupling together the opposing ends to form a cylindrical structure.

15. The method of claim 14, wherein the raceway includes a plurality of axially spaced annular insulators, each of the annular insulators including a cavity receiving one of the annular contact rings.

16. The method of claim 14, further comprising the step of radially biasing each of the contact blades into contact with one of the annular contact rings.

17. A method of providing electrical communication, the method comprising the steps of:

providing a stationary member;

providing a rotatable member for rotation relative to the stationary member, the rotatable member defining a center opening;

coupling a raceway to one of the stationary member and the rotatable member, the raceway including a plurality of axially spaced annular contact rings;

coupling a blade tower to the other of the rotatable member and the stationary member, the blade tower including a plurality of axially spaced blade assemblies, each blade assembly including a radially extending contact blade in electrical communication with one of the axially spaced contact rings of the raceway;

traversing an individual within the center opening of the rotatable member; and rotating the rotatable member relative to the stationary member, wherein the contact blades of the blade assemblies remain in electrical communication with the contact rings of the raceway, and further comprising coupling to the rotatable member at least one of a turret, a crane, and a ladder.

* * * * *